US007037091B2

(12) United States Patent
Chumley et al.

(10) Patent No.: US 7,037,091 B2
(45) Date of Patent: May 2, 2006

(54) CRANKCASE HEATER MOUNTING FOR A COMPRESSOR

(75) Inventors: Eugene Karl Chumley, Abingdon, VA (US); David Turner Monk, Bristol, VA (US); Scott Garrison Hix, Bristol, VA (US); William Terry Addison, Bristol, TN (US)

(73) Assignee: Bristol Compressors, Inc., Bristol, VA (US)

( * ) Notice: Subject to any disclaimer, the term of this patent is extended or adjusted under 35 U.S.C. 154(b) by 358 days.

(21) Appl. No.: 10/440,755

(22) Filed: May 19, 2003

(65) Prior Publication Data

US 2004/0234388 A1 Nov. 25, 2004

(51) Int. Cl.
*F01M 5/00* (2006.01)

(52) U.S. Cl. ..... 417/572; 417/902; 184/6.22

(58) Field of Classification Search ..... 417/423.14, 417/572, 902; 184/6.22
See application file for complete search history.

(56) References Cited

U.S. PATENT DOCUMENTS 3,564,199 A * 2/1971 Blaha ..... 219/205
4,506,519 A 3/1985 Morse et al.
4,566,861 A 1/1986 Landfors
4,755,657 A 7/1988 Crim et al.
4,995,791 A 2/1991 Luprete
5,154,582 A 10/1992 Danielson
5,161,955 A 11/1992 Danielson et al.
5,194,717 A 3/1993 Cowen et al.
5,252,036 A 10/1993 Bunch et al.
2002/0139137 A1 10/2002 Tipton
2004/0118146 A1 6/2004 Haller et al.

FOREIGN PATENT DOCUMENTS

EP 0 546 982 A1 6/1993
EP 0 822 339 A2 2/1998

* cited by examiner

*Primary Examiner*—Charles G. Freay
(74) *Attorney, Agent, or Firm*—McNees Wallace & Nurick LLC

(57) ABSTRACT

A crankcase heater mounting and compressor system that efficiently heats the oil sump fluid in an oil sump of a crankcase. A heater well is disposed in a substantially planar section in the lower housing shell of the crankcase. The inner surface of the heater well is substantially submerged in the oil sump fluid even at low oil sump fluid levels.

24 Claims, 5 Drawing Sheets

CRANKCASE HEATER MOUNTING FOR A COMPRESSOR

FIELD OF THE INVENTION

The present invention is directed to a mounting for a beater in the oil reservoir of a compressor crankcase in order to heat the liquid in the reservoir and evaporate any liquid refrigerant that may be present in the oil reservoir.

BACKGROUND OF THE INVENTION

The invention concerns refrigeration or heating, ventilation, and air conditioning ("HVAC") compressor units of the hermetically sealed type wherein the compressor housing or "shell" encloses the compressor, its drive motor and associated components. The compressor housing typically includes upper and lower cup shaped sections, which, after the compressor, motor, and associated components are mounted therein, are secured together, e.g., by welding along the peripheral mating joint formed by the mated contiguous open end portions of the shell sections.

It is customary in the design and manufacture of such compressors to dimension and configure the shell sections to adequately accommodate, spacewise, the compressor, its motor, and the various auxiliary components, such as, a motor mounting, a suction feed system, a discharge loop, a discharge muffler, and the like. Such design considerations are important, however, other design needs such as diminishing the inherent property of the shell to transmit objectionable noise at objectionable frequencies should be considered and are often compromised by paramount space considerations such as the dimensions and configuration of the refrigeration or air conditioning system housing or cabinet into which the compressor unit must precisely fit.

Objectionable noise is transmitted by the shell and originates or propagates therein either by the mechanical elements of the compressor such as the suction and discharge valves, or by the compression of the refrigerant therein, e.g., pulsations within the suction or discharge system. In this regard, it is recognized by those skilled in the art that the source of the noise, its mode of propagation within the shell, and its manner of transmission by the shell to the human ear are all extremely difficult to understand and predict, and of course, to control.

One of the key components for the operation of the compressor is the oil that is used for the lubrication of the mechanical components of the compressor. The oil to be used in the compressor collects in the oil sump at the base of the lower section of the compressor housing and is pumped or drawn into the moving compressor components from the sump.

Normal operation of the compressor also involves pumping refrigerant though the compressor. Such refrigerant is ideally maintained in gaseous form during its time within the compressor. However, some of the refrigerant may condense and drain into the oil sump. Such condensation can cause dilution of the oil in the oil sump, which hinders the ability of the oil to lubricate the mechanical components of the compressor. It is desirable to have no refrigerant in the oil within the oil sump.

Typically, the oil sump is heated with a heater assembly in order to evaporate any refrigerant condensate that accumulates in the oil sump. The heater assembly is normally positioned in a heater well that is located in the compressor housing near the oil sump. However, because of compressor design considerations the heater well is positioned perpendicularly to, and within, the generally cylindrical side of the compressor. Such a configuration means that the heater well is not always substantially submerged within the oil. At best, the well is only partially submerged into the oil of the oil sump, with the heater well mounted directly on the side of the substantially cylindrical compressor housing. In addition to failing to efficiently transfer heat from the heater to the oil, such a heater well configuration causes a significant amount of sound and other vibrations created by the operation of the compressor to be projected out into the environment.

In addition, the patent literature shows many variations of compressor unit shell heating assembly configurations, including U.S. Pat. Nos. 5,194,717; 5,252,036; and 4,755,657, which attempt to address these existing problems. These heating assemblies are directed toward heating elements that are mounted on the exterior wall of the crankcase and are not designed to function within a heater well element.

What is required is a crankcase heater assembly that causes less noise and vibration from the operation from the compressor to be projected out into the environment to reduce the volume of the sound and intensity of the vibration caused by normal compressor operation and to more efficiently transfer heat from the heating element to the oil in order to more quickly vaporize coolant.

SUMMARY OF THE INVENTION

The present invention is directed to a hermetic compressor crankcase housing and a hermetic compressor system.

The present invention hermetic compressor housing unit includes a shell having an upper and lower section. Both the upper and lower sections have substantially cylindrical portions or sidewalls with an open end, which, when mated, form a generally cylindrical shell. The lower section has a base portion that is positioned opposite the open end of its substantially cylindrical portion. The base portion is bowl shaped and has one or more substantially planar portions disposed adjacent to and below the substantially cylindrical portion. The substantially planar portion is disposed at an obtuse angle to a plane tangent to the substantially cylindrical sidewall of the lower section.

A heater well, with an outer surface and an inner surface, is disposed or positioned on a substantially planar portion in the lower section of the housing and extends into the interior of the lower section of the housing. The inner surface of the heater well faces the interior of the housing, while a portion of the outer surface of the heater well forms a chamber having an opening. The chamber is designed to receive a heater assembly. Such heater assemblies are well known in the art. The geometry of the housing, particularly location and geometry of the substantially planar surface in the lower section of the housing and the location of the heater well serves to diminish the inherent property of the shell to transmit objectionable noise and vibration at objectionable frequencies when compared to prior art shells. The smaller the surface area of the substantially planar section, and the more vertical the substantially planar section, the less sound and vibration is generated by the shell. However, if the heater wall were mounted on the vertical sidewall of the housing, the amount of sound and vibration generated during operation of the compressor would be increased.

The compressor system provided by the present invention is designed to function with many types of presently manufactured internal components, including systems that utilize single or multiple cylinders, motors and auxiliary components. The hermetic compressor housing unit has a shell having an upper and lower section which both have substantially cylindrical portions and which, when mated, form a generally cylindrical shell. The lower section has a base portion that is positioned adjacent to and below its substantially cylindrical portion. The base portion also has one or more substantially planar portions disposed adjacent to and below the substantially cylindrical portion. The substantially planar portion is disposed at an obtuse angle to a plane tangent to the substantially cylindrical portion of the lower section.

An oil sump is also located in the interior of the lower section of the housing. The oil sump generally includes oil, but may include oil mixed with condensed refrigerant. The fluid within the oil sump, whether oil, refrigerant, other lubricant, or other fluid is referred to herein as oil sump fluid. During normal operation, refrigerant is pumped through the compressor. Ideally, the refrigerant remains in a vapor state as it is cycled through the compressor. However, condensed refrigerant in the compressor shell may drain into the oil sump at the base of the compressor.

Oil sump fluid occupies at least a preselected minimum volume within the oil sump, such minimum volume being occupied when the oil sump fluid does-not contain any refrigerant during normal operation of the compressor. When the oil occupies the preselected minimum volume within the oil sump, the oil sump fluid rises to a preselected minimum height in the oil sump. The drainage of condensed refrigerant into the oil sump increases the volume of the oil sump fluid above its minimum volume. The presence of any liquid refrigerant within the sump increases the level of the oil sump fluid above its minimum height during normal operation of the compressor.

A heater well, with an outer surface and an inner surface, is located within a substantially planar portion in the lower section of the housing. The inner surface of the heater well faces the interior of the housing, while a portion the outer surface of the heater well forms a chamber having an opening. A substantial-portion of the inner surface of the heater well is in contact with the oil sump fluid at the preselected minimum oil sump fluid level. At higher levels of oil sump fluid, the entire inner surface of the heater well is in contact with the oil sump fluid. The chamber is designed to receive a heater assembly, such heater assemblies being well known in the art. The geometry of the housing, particularly the location and geometry of the substantially planar portion in the lower section of the housing and the location of the heater well serves to diminish the inherent property of the shell to transmit objectionable noise and vibrations at objectionable frequencies.

It is important, during both start-up and normal operation of the compressor to keep any refrigerant within the compressor housing in a vapor state and out of the oil sump. Since the refrigerant vaporizes at a lower temperature than the oil, heating the oil sump fluid above the evaporation temperature of the refrigerant serves to vaporize the refrigerant without vaporizing the oil. As the refrigerant is vaporized, it increases the partial pressure of the refrigerant within the compressor. The higher refrigerant vapor pressure within the compressor serves to prevent further condensation of the refrigerant vapor in the compressor housing. Since the interior of the heater well is substantially immersed in the oil sump fluid, even at low oil sump fluid levels, the heat generated from the heater unit located in the heater well is efficiently transferred from the heater assembly into the oil sump fluid. This transmission of heat directly from the heater unit into the oil sump fluid within the oil sump efficiently heats the oil sump fluid, driving any refrigerant located in the oil sump out of the oil sump fluid.

An advantage of this invention is a reduction in the amount of noise and vibration generated by a hermetic compressor during normal operation resulting from the position of the heater well within a substantially planar section of the housing.

Another advantage of this invention is efficient heating of the oil sump fluid in the lower section of a hermetic compressor by having the inner surface of a heater well substantially submerged in the oil sump fluid even at minimum oil sump fluid levels.

Another advantage of this invention is to provide efficient heating of the oil sump fluid in the lower section of a hermetic compressor by having the inner surface of a heater well completely submerged in the oil sump fluid at high oil sump fluid levels.

Other features and advantages of the present invention will be apparent from the following more detailed description of the preferred embodiment, taken in conjunction with the accompanying drawings which illustrate, by way of example, the principles of the invention.

Another advantage of this invention is the ability to use a smaller heater well as the heater well is at an angle rather than positioned horizontally.

DETAILED DESCRIPTION OF THE INVENTION

The compressor crankcase shell or housing of the present invention preferably has a generally cylindrical shape, and is dimensioned to enclose a compressing device, electric motor, and any corresponding auxiliary components such as a discharge muffler, suction line, motor cap or suction plenum, and the like. A typical compressor having utility for the present invention is shown in U.S. Pat. No. 4,995,791, the disclosure of which is incorporated herein by reference.

Figure 1:
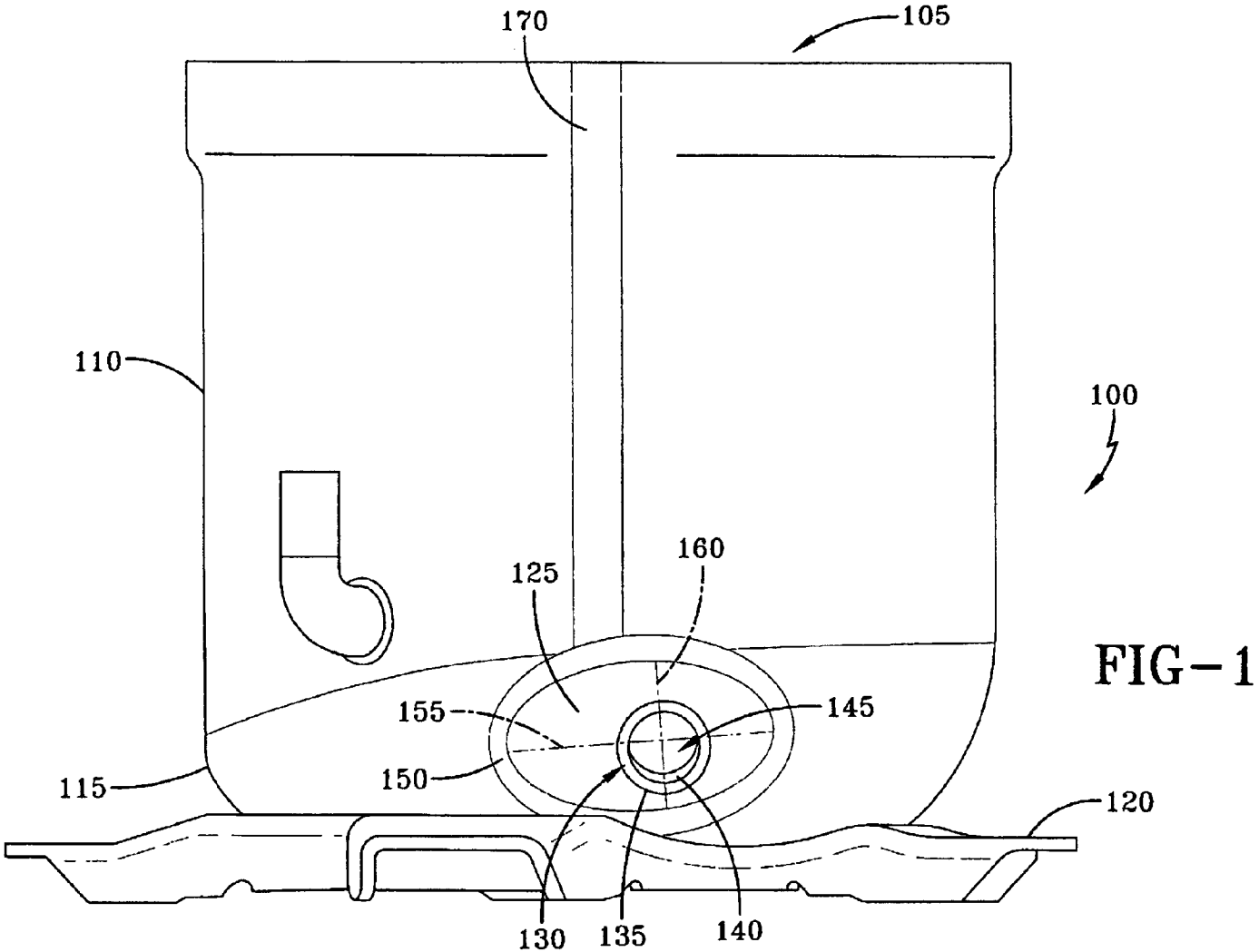
FIG. 1 is an side view of a lower compressor shell section of an embodiment of the present invention.

Referring now to FIG. 1, the hermetic compressor of the present invention includes two sections, an upper section 165 (shown in FIG. 5) and a lower section 100, which are connected or secured together to form the compressor shell. The upper section 165 and lower section 100 are preferably formed by a metal drawing operation from low carbon sheet steel of a substantially uniform thickness. It is understood that the upper section 165 and lower section 100 can be formed by any suitable process and can have any suitable thickness. The lower section 100 has a substantially cup or bowl shape. The lower section 100 has an opening 105, a substantially cylindrical sidewall 110 extending from the opening 105, and a closed end portion or base section 115 disposed opposite the opening 105. A mounting foot 120 supports the base section 115. In a preferred embodiment of the invention, the opening of the upper shell section 165 is designed to nest or fit within the opening 105 of the lower shell section 100. The upper section 165 and lower section 100 are preferably connected by welding to form the housing, although other suitable techniques can be used. The opening 105 of the lower section 100 has a generally circular or more preferably oval cross-sectional geometry.

The base section 115 has one or more substantially planar sections 125 that are disposed adjacent to and below the substantially cylindrical section 110. In a preferred embodiment of the present invention, the base section 115 has a pair of substantially planar sections 125 disposed on opposite sides of the lower section 100. The one or more substantially planar sections 125 are preferably elongated closed geometric shapes with a major axis 155 having a length in the range of about 2 inches to about 4 inches, and a minor axis 160 having a length in the range of about 1 inch to about 3 inches. The, major axis 155 extends in an elongated length of the closed geometric shape and the minor axis 160 extends in a non-elongated length of the closed geometric shape. The major axis 155 and the minor axis 160 are preferably substantially perpendicular to one another. As defined herein, "substantially perpendicular" means at an angle in the range of about perpendicular to about 20 degrees away from perpendicular.

The heater well 130 of the present invention is shown extending into the lower section 100. Only the outer surface 135 of the heater well 130 is seen from this perspective. The outer surface 135 forms a chamber 140 with an opening 145.

In a preferred embodiment, an outwardly curved transitional section 150 surrounds the substantially planar section 125. The transitional sections 150 serve to transition the geometry of the substantially planar sections 125 into the geometry of the base section 115 and the substantially cylindrical section 110, if necessary.

In one embodiment, a substantially linear segment 170 originates at the opening 105 of the lower section 100 and extends in the sidewall 110 of the lower section 100 toward the base section 115. In the embodiment shown in FIG. 1, the substantially linear segment 170 extends almost the entire length of the lower section 100 and the entire length of the substantially cylindrical sidewall 110 before being blended into the transitional section 150.

Figure 2:
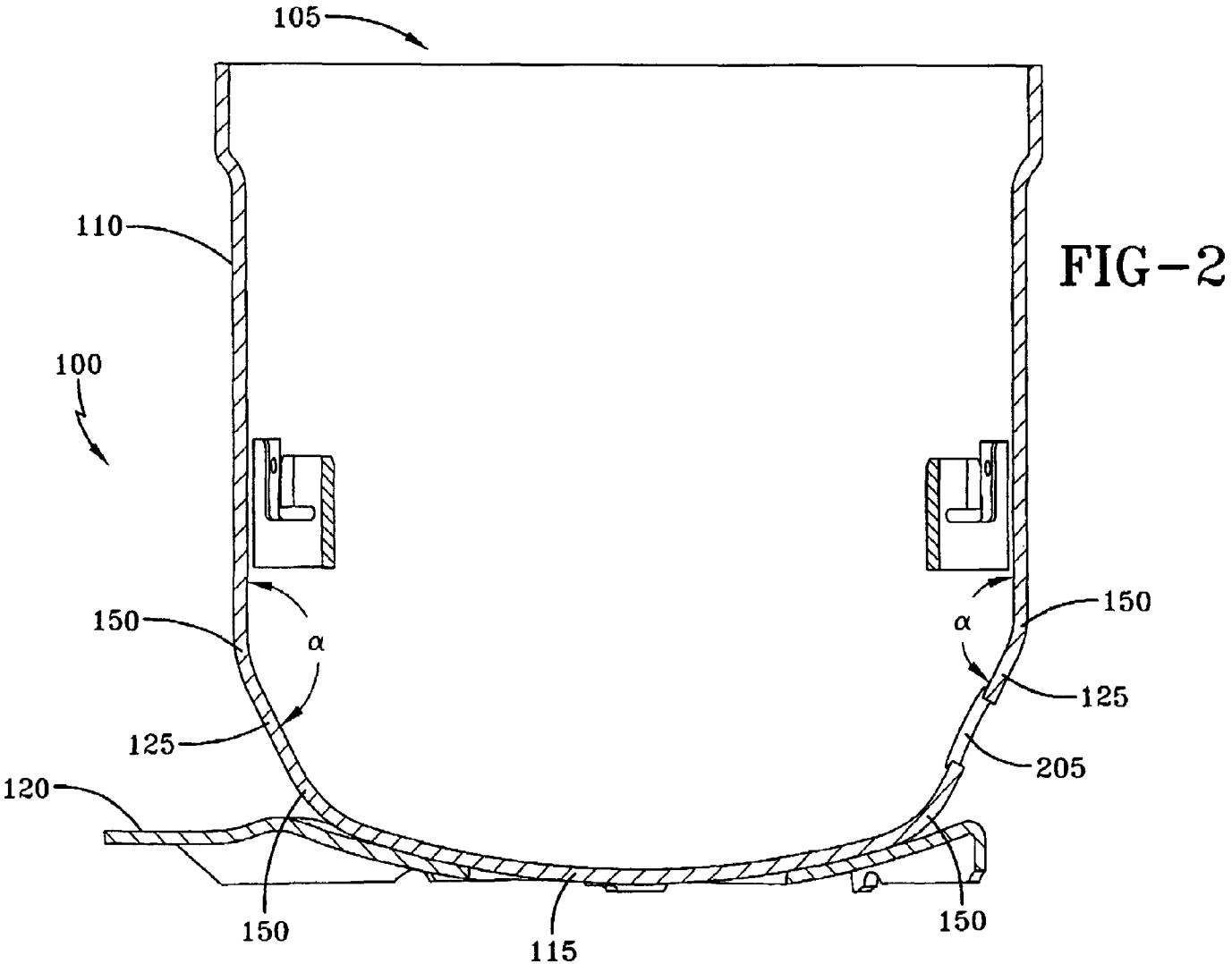
FIG. 2 is a side cross-sectional view of a lower compressor shell section of the present invention.

Referring now to FIG. 2, a side cross-sectional view of the lower section 100 again shows the elements of the present invention, including the opening 105 in the lower section 100, the substantially cylindrical sidewall 110, the base section 115, a pair of substantially planar sections 125, the transitional sections 150 and the mounting foot 120. An opening 205 is clearly visible in one of the substantially planar sections 125. The opening 205 is designed to receive the heater well 130 of the present invention. The substantially planar sections 125 are disposed at an obtuse angle $\alpha$ (as shown in FIG. 2) in the range of about 145° to about 160° to a plane tangent to the substantially cylindrical sidewall 110 of the lower section 100. In a preferred embodiment, the substantially planar sections 125 are disposed at an obtuse angle a of about 153°.

Figure 3:
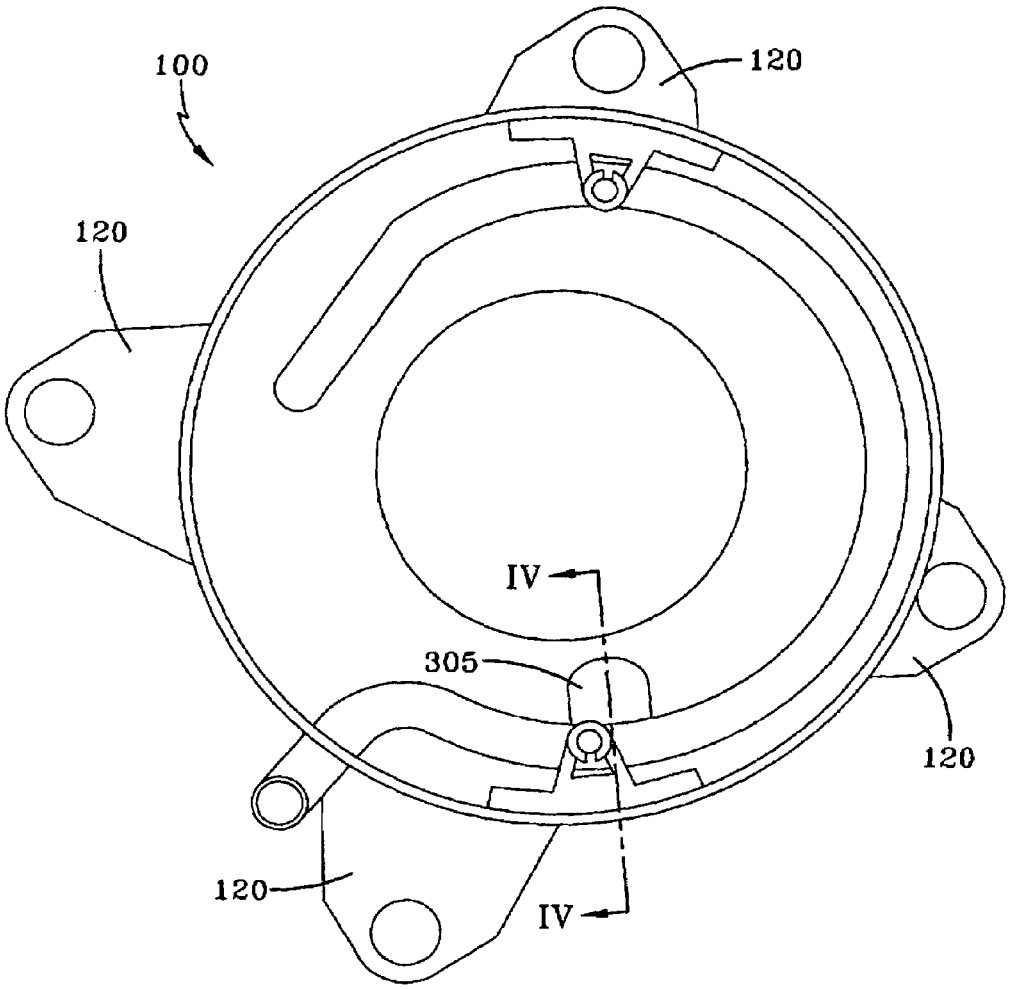
FIG. 3 is a partial top view of the lower compressor shell section of the present invention.

Referring now to FIG. 3, the partial top view of the lower section 100 illustrates the preferred positioning and substantially cylindrical-shape of the heater well 130 of the present invention. As this is a top view of the compressor housing, only the inner surface 305 of the heater well 130 is visible in addition to some other components. A portion of the mounting foot 120 is also visible from this perspective.

Figure 4:
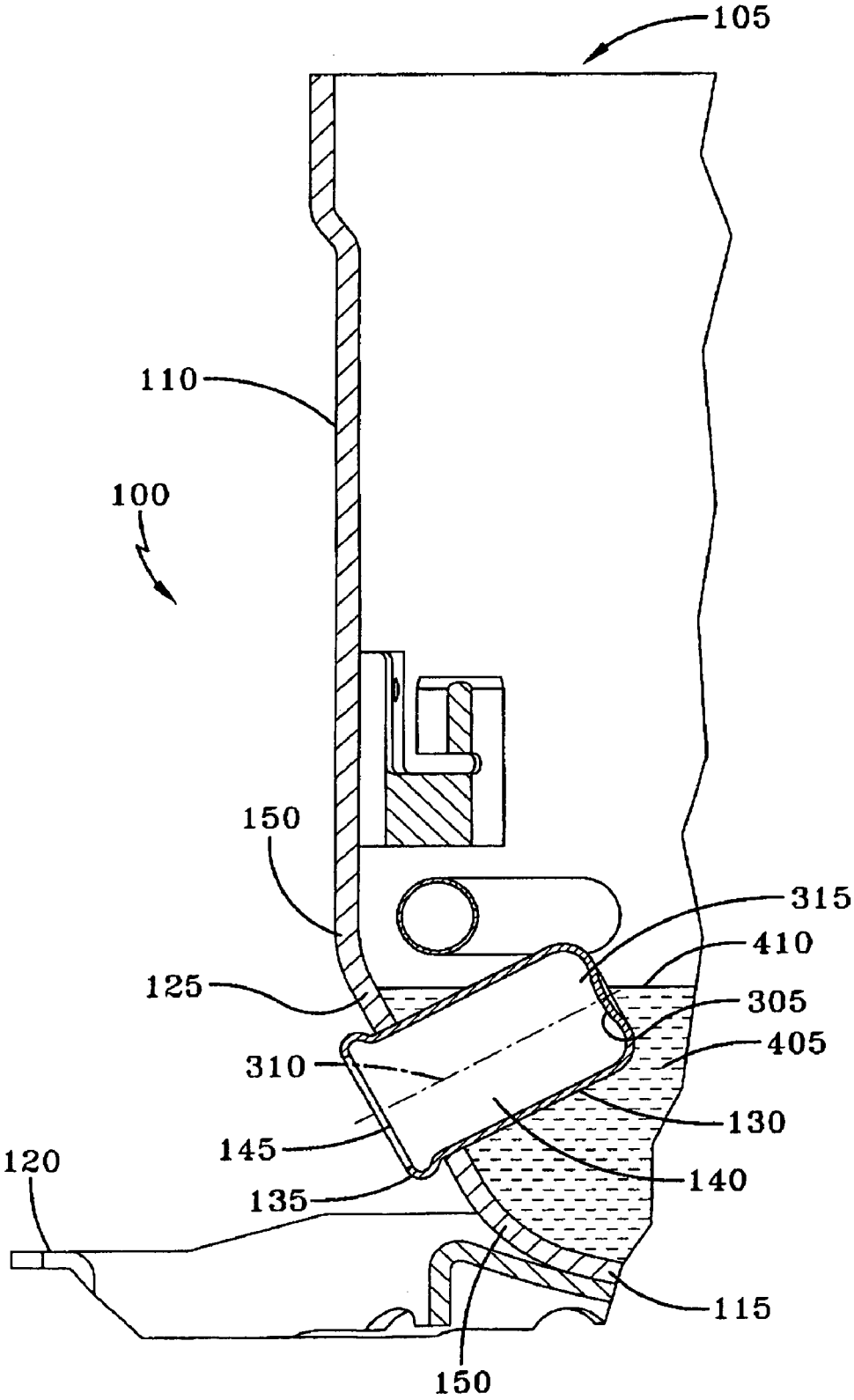
FIG. 4 is partial cross-sectional view of the lower compressor shell section of FIG. 3 take along line IV—IV.

Referring now to FIG. 4, which clearly shows the features of the preferred embodiment of the present invention. The opening 105 of the lower section 100, the substantially cylindrical sidewall 110, the base section 115, the substantially planar section 125, the transitional section 150 and the mounting foot 120 are visible. The heater well 130 is clearly disposed in the substantially planar section 125 and extends into the lower section 100 where the oil sump 405 is located. The oil sump 405 contains oil sump fluid, which includes oil or an oil and refrigerant mixture. In a preferred embodiment, the center axis 310 of the heater well 130 is positioned substantially perpendicularly to the substantially planar section 125, the opening 145 in the chamber is substantially circular, and length of the heater well 130 along the center axis 310 is greater than the diameter of the opening 145. In another embodiment, the diameter of the opening 145 and the length of the heater well 130 may be varied to any suitable sizes. In a preferred embodiment, the substantially circular opening 145 has a diameter in the range of about 0.5 inch to about 1.5 inches. The geometry of the opening 145 is not limited to substantially circular and may be of any geometric shape sufficient to receive a heater, such as a D-shape or other geometric shape.

The inner surface 305 of the heater well 130 faces the interior of the lower section 100, while a portion the outer surface 135 of the heater well 130 forms a chamber 140 having an opening 145. A portion of the outer surface 135 of the heater well 130 preferably may form a collar to assist in the welding of the heater well to the lower section 100. The collar also prevents the heater well 130 from falling into the compressor by pushing through the opening 205. The chamber 140 is designed to receive a heater assembly. Such heater assemblies are well known in the art.

In a preferred embodiment, the heater well 130 has a thickness less than the lower section 100 in order to more rapidly transmit heat through the heater well 130 into the oil sump 405. Additionally, while it is preferable to hermetically weld the heater well 130 to the lower section 100, the heater well 130 may be manufactured as a unitary component with the lower section 100, provided that the connection between the heater well 130 and the lower section 100 is watertight. The heater well 130 attached to the lower section 100 is referred to herein as the heater mounting.

The level 410 of oil sump fluid in the oil sump 405 illustrates the minimum level 410 of oil sump fluid in the oil sump 405 required to maintain proper operation of the compressor. The oil occupies at least a preselected minimum volume within the oil sump 405, such minimum volume being occupied when the oil sump 405 does not contain any refrigerant as is shown by oil sump fluid level 410 in FIG. 4. During normal operation of the compressor, refrigerant is cycled through the compressor. Ideally, the refrigerant remains in a vapor state before it is cycled through the compressor. However, condensed refrigerant may form in the compressor shell and drain into the oil sump 405 at the base of the compressor. Such drainage of refrigerant into the oil sump 405 increases the volume of the oil sump fluid above its minimum volume. The presence of any refrigerant within the oil sump 405 increases the level of the oil sump fluid level 410 above its minimum normal operating height. During operation of the compressor, the level of the oil sump fluid could rise above the minimum normal operating level due to the drainage of condensed refrigerant (not shown) into the oil sump 405, which increases the minimum level 410 of oil sump fluid in the oil sump 405. In one embodiment of the present invention, the inner surface 305 of the heater well 130 preferably remains submerged in the oil sump fluid at all times.

It is important, during both start-up and normal operation of the compressor to keep any refrigerant within the compressor housing in a vapor state and out of the oil sump 405.

Since the refrigerant vaporizes at a lower temperature than the oil 410, heating the oil 410 above the evaporation temperature of the refrigerant serves to vaporize the refrigerant without vaporizing the oil 410. As the refrigerant is vaporized, it increases the partial pressure of the refrigerant within the compressor. In the present invention, the heater well 130 is designed to receive a heating element (not shown). Such heating elements are well known in the art. When the heating element is turned on, heat is created by the heating element and is transferred from the heater element through the heater well 130 into the oil sump fluid in the oil sump 405. Since the inner surface 305 of the heater well 130 is substantially immersed in the oil sump fluid, even at low oil sump fluid levels where the oil sump fluid is almost completely oil, the heat generated from the heater unit located in the heater well is efficiently transferred from the heater assembly into the oil sump fluid. In a preferred embodiment, about two-thirds of the inner surface 305 of heater well 130 is immersed in the oil sump fluid. In a preferred embodiment, during start-up condition where a substantial amount of refrigerant is present in the oil sump, the inner surface of the heater well 130 is completely immersed in the oil sump fluid. This transmission of heat directly from the heater unit to the oil sump fluid efficiently heats the oil sump fluid, driving any refrigerant located in the oil sump fluid out of the oil sump fluid. While the heater well 130 is preferably cylindrical in shape with a closed end 315, it may be of any suitable geometric shape, as long as the inner surface 305 is completely submerged in the oil sump fluid of the oil sump 405. In a preferred embodiment, the level 410 of the oil sump fluid is about 1.5 inches to about 2 inches. In an optional embodiment, fins are attached the heater well 130, which increases the rate of transfer of heat from the heater to the oil sump fluid.

The geometry of the lower housing 100 and the position of the substantially planar section 125 and the heater well 130 in the lower shell serves to reduce the noise and other vibrations generated by the operation of the compressor. The location and geometry of the heater well 130 also serves to reduce the internal volume of the compressor that is occupied by the heater well. In a preferred embodiment, the presence of the transitional section 150 between the substantially planar section 125 and the substantially cylindrical section 110 and the base section 115 further serves to reduce the noise and other vibrations generated by the operation of the compressor. The noise and other vibrations produced by the heater well 130 and heater assembly during normal operation are reduced by placing the heater well 130 in an area of high mechanical impedance, which is an area that is inherently low in vibrational energy during normal compressor operation. The base portion 115 of the lower section 100 is an area of relatively high mechanical impedance and low sound radiation efficiency as compared to the substantially cylindrical sidewall 110. By placing the heater well 130 in an relatively small substantially planar portion 125 of the base portion 115, the sound radiation and fatigue failures of the heater well 130 are reduced when compared to a heater well that is placed in the cylindrical sidewall. The low sound radiation efficiency of the base portion 115 ensures low sound radiation from the heater well 130 and heater assembly, when the low vibration energy present at the heater well 130 location is taken into account.

Figure 5:
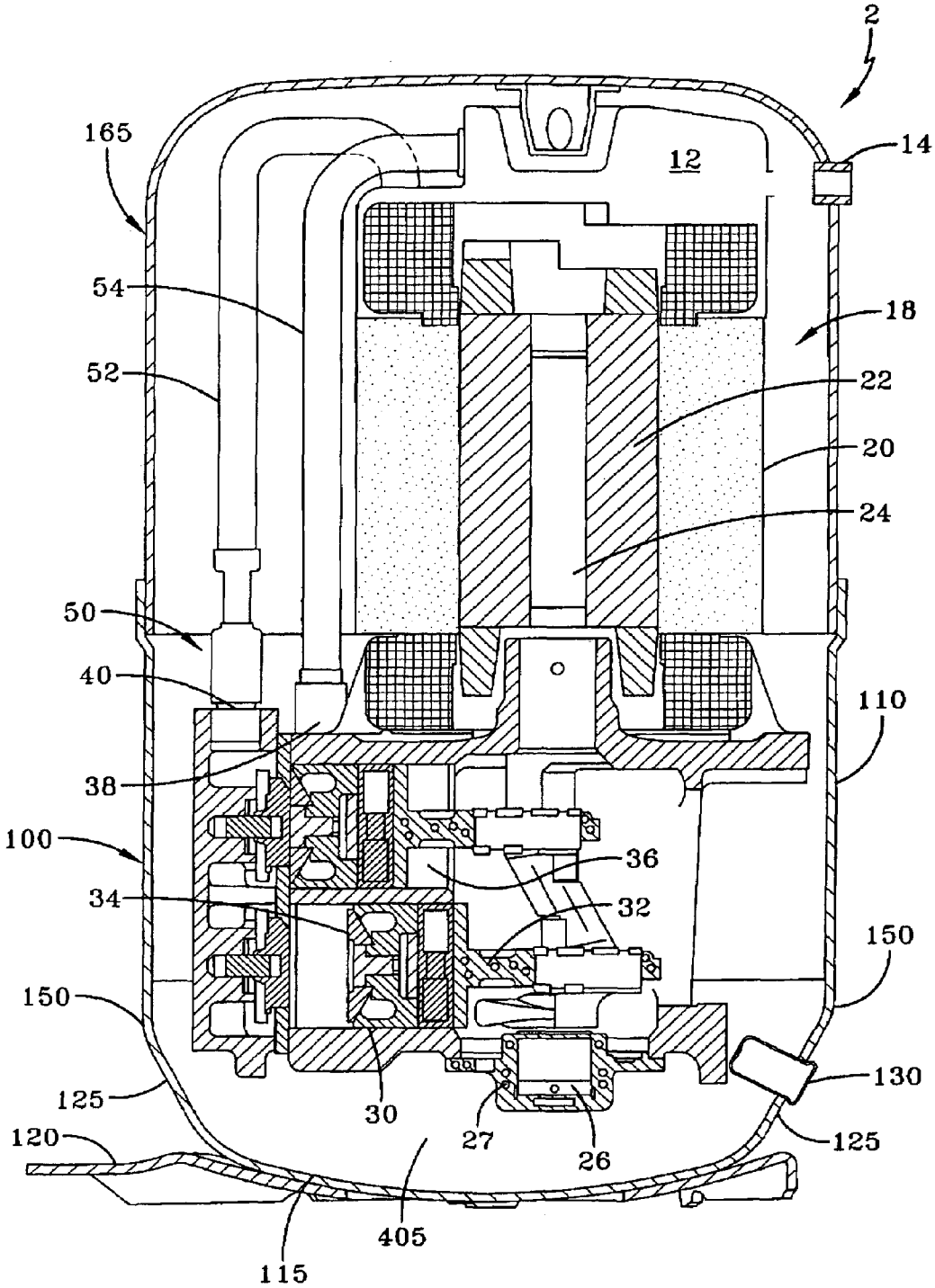
FIG. 5 is a side cross-sectional view of a compressor system from one embodiment of the present invention.

Referring now to FIG. 5, one embodiment of a compressor system that incorporates the heater mounting of the present invention is depicted in FIG. 5. The compressor 2 is connected to a conventional refrigeration or HVAC system (not shown) having a condenser, expansion device and evaporator in fluid communication with the compressor 2. Compressor 2 is preferably a reciprocating compressor connected to an evaporator (not shown) by a suction line that enters the suction port 14 of compressor 2. Suction port 14 is in fluid communication with suction plenum 12. Refrigerant gas from the evaporator enters the low pressure side of compressor 2 through suction port 14 and then flows to the suction plenum 12 before being compressed.

Compressor 2 includes an electrical motor 18. A standard induction motor having a stator 20 and a rotor 22 is shown. However any other electrical motor may be used. A shaft assembly 24 extends through rotor 22. The bottom end 26 of shaft assembly 24 in this compressor 2 extends into an oil sump 405 and includes a series of apertures 27. Connected to shaft assembly 24 below the motor is at least one piston assembly 30. Compressor 2 of FIG. 5 depicts two piston assemblies. A connecting rod 32 is connected to a piston head 34, which moves back and forth within cylinder 36. Cylinder includes a gas inlet port 38 and a gas discharge port 40. Associated with these ports 38, 40 are associated respectively suction valves and discharge valves (not shown) assembled in a manner well known in the art. Gas inlet port 38 is connected to an intake tube 54, which is in fluid communication with suction plenum 12.

Motor 18 is activated by a signal in response to a predetermined condition, for example, an electrical signal from a thermostat when a preset temperature is reached. Electricity is supplied to stator 20, and the windings in the stator 20 causes rotor 22 to rotate. Rotation of rotor 22 causes the shaft assembly 24 to turn. In the compressor shown, oil sump fluid in the oil sump 405 and which has moved through apertures 27 in bottom end 26 of shaft is moved upward through and along shaft 24 to lubricate the moving parts of compressor 2.

Rotation of rotor 22 also causes reciprocating motion of piston assembly 30. As the assembly moves to an intake position, piston head 34 moves away from gas inlet port 38, the suction valve opens and refrigerant fluid is introduced into an expanding cylinder 36 volume. This gas is pulled from suction plenum 12 within upper section 16. This gas is sucked into intake tube 54 to gas inlet port 38 where it passes through suction valve and is introduced into cylinder 36. When piston assembly 30 reaches a first end (or top) of its stroke, shown by movement of piston head 34 to the right side of cylinder 36 of FIG. 5, suction valve closes. The piston head 34 then compresses the refrigerant gas by reducing the cylinder 36 volume. When piston assembly 30 moves to a second end (or bottom) of its stroke, shown by movement of piston head 34 to the left side of cylinder 36 of FIG. 5, a discharge valve is opened and the highly compressed refrigerant gas is expelled through gas discharge port 40. The highly compressed refrigerant gas flows from the gas discharge port 40 into a muffler 50 then through an exhaust or discharge tube 52, exiting the compressor housing 16 into a conduit connected to a condenser. This comprises one cycle of the piston assembly 30.

The heater well 130 of the present invention is clearly shown disposed in a substantially planar section 125 of the lower housing. The substantially cylindrical sidewall 110, the base section 115, transitional sections 150, and the mounting foot 120 are also clearly visible.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A shell section for a compressor, the shell section comprising:

a substantially cylindrical sidewall having an opening;

a base section connected to the substantially cylindrical sidewall and disposed opposite the opening, the base section having a substantially planar portion, wherein the substantially planar portion is disposed at an obtuse angle to a plane tangent to the substantially cylindrical sidewall; and a heater extending from the substantially planar portion into the shell section, the heater well being disposed substantially perpendicular to the substantially planar portion.

2. The shell section of claim 1, wherein the substantially planar section is disposed adjacent to the substantially cylindrical sidewall.

3. The shell section of claim 1, wherein the heater well comprises an inner surface and an outer surface, a portion of the outer surface forming a chamber, said chamber having an opening.

4. The shell section of claim 3, wherein the shell section further comprises an outwardly curved transitional portion, said transitional section being adjacent to the substantially cylindrical sidewall, the base section, and the substantially planar portion, said transitional portion surrounding the substantially planar portion, said transitional portion transitioning the geometry of the substantially planar portion into the geometry of the substantially cylindrical sidewall and the base section.

5. The shell section of claim 4, wherein the heater well is substantially cylindrical with a closed end, wherein the heater well has a center axis, wherein the opening in the chamber is substantially circular, and wherein the center axis of the heater well is perpendicular to the substantially planar portion.

6. The shell section of claim 5, wherein the length of the heater well along the center axis is greater than the diameter of the opening.

7. The shell section of claim 6, wherein the obtuse angle is in the range of about 145 degrees to about 160 degrees.

8. The shell section of claim 7, wherein the obtuse angle is about 153 degrees.

9. The shell section of claim 1, wherein the obtuse angle is in the range of about 145 degrees to about 160 degrees.

10. The shell section of claim 9, wherein the obtuse angle is about 153 degrees.

11. The shell section of claim 4, wherein the obtuse angle is in the range of about 145 degrees to about 160 degrees.

12. The shell section of claim 11, wherein the obtuse angle is about 153 degrees.

13. A compressor system comprising:

an upper section having a substantially cylindrical sidewall;

a lower section, having a substantially cylindrical sidewall, a base section connected to the substantially cylindrical sidewall and disposed opposite the upper section, the base section having a substantially planar portion, wherein the substantially planar portion is disposed at an obtuse angle to a plane tangent to the substantially cylindrical sidewall of the lower section;

an electric motor disposed in the housing;

a compression apparatus disposed in the housing, the compression apparatus being configured and disposed to be driven by the electric motor;

a fluid disposed in the lower section of the housing to form a sump, the fluid comprising oil to lubricate the compressor apparatus; and a heater well extending from the lower section into the sum, the heater well being disposed to be substantially submerged in the fluid.

14. The compressor system of claim 13, wherein the substantially planar portion is disposed adjacent to the substantially cylindrical sidewall.

15. The compressor system of claim 13, wherein the heater mounting further comprises the heater well having an inner surface and an outer surface, a substantial portion of the inner surface of the heater well being submerged in the oil sump fluid, a portion of the outer surface forming a chamber, said chamber having an opening.

16. The compressor system of claim 15, wherein the lower section further comprises an outwardly curved transitional portion, said transitional section being adjacent to the substantially cylindrical sidewall of the lower section, the base section, and the substantially planar portion, said transitional portion surrounding the substantially planar portion, said transitional portion transitioning the geometry of the substantially planar portion into the geometry of the substantially cylindrical sidewall of the lower section and the base section.

17. The compressor system of claim 16, wherein the heater well is substantially cylindrical with a closed end, wherein the heater well has a center axis, wherein the opening in the chamber is substantially circular, wherein the center axis of the heater well is perpendicular to the substantially planar portion.

18. The compressor system of claim 17, wherein the length of the heater well along the center axis is greater than the diameter of the opening.

19. The compressor system of claim 18, wherein the obtuse angle is in the range of about 145 degrees to about 160 degrees.

20. The compressor system of claim 19, wherein the obtuse angle is about 153 degrees.

21. The compressor system of claim 13, wherein the obtuse angle is in the range of about 145 degrees to about 160 degrees.

22. The compressor system of claim 21, wherein the obtuse angle is about 153 degrees.

23. The compressor system of claim 16, wherein the obtuse angle is in the range of about 145 degrees to about 160 degrees.

24. The compressor system of claim 23, wherein the obtuse angle is about 153 degrees.

* * * * *

UNITED STATES PATENT AND TRADEMARK OFFICE

CERTIFICATE OF CORRECTION

PATENT NO. : 7,037,091 B2
APPLICATION NO. : 10/440755
DATED : May 2, 2006
INVENTOR(S) : Eugene Karl Chumley et al.

It is certified that error appears in the above-identified patent and that said Letters Patent is hereby corrected as shown below:

Column 5, Line 56, "angle a of" should be - - angle α of - - .

Column 10, Line 15 "sum" should be - - sump - -.

Signed and Sealed this

Twenty-second Day of August, 2006

JON W. DUDAS
*Director of the United States Patent and Trademark Office*